United States Patent [19]

Howat et al.

[11] Patent Number: 4,647,334

[45] Date of Patent: Mar. 3, 1987

[54] APPARATUS FOR CABLE MANUFACTURE USING AN EXTRUDER AND CORE WRAP

[75] Inventors: Robert J. Howat, Carp; Kenneth R. Kirkwood, Kingston, both of Canada

[73] Assignee: Northern Telecom Limited, Montreal, Canada

[21] Appl. No.: 712,946

[22] Filed: Mar. 18, 1985

[51] Int. Cl.[4] ..... H01B 13/22

[52] U.S. Cl. ..... 156/461; 29/33 E; 29/828; 72/368; 156/54

[58] Field of Search ..... 29/33 D, 33 E, 825, 29/828; 72/367, 368; 156/54, 461

[56] References Cited

U.S. PATENT DOCUMENTS 4,377,908 3/1983 Pan ..... 29/828

4,404,720 9/1983 Bohannon ..... 29/33 E

*Primary Examiner*—Robert A. Dawson

*Attorney, Agent, or Firm*—R. J. Austin

[57] ABSTRACT

In the manufacture of electrical cable and after a core wrap is applied to the cable core, the core wrap is moved downstream and is held in a closed position around the core by a retaining member which holds edges of the wrap in overlapped relationship. The core wrap is held closed to enable it to be covered in its closed condition by a jacket. The retaining member is movable and is shaped so that during movement into different positions of orientation, it will maintain its function of holding the core wrap closed.

3 Claims, 3 Drawing Figures

APPARATUS FOR CABLE MANUFACTURE USING AN EXTRUDER AND CORE WRAP

This invention relates to cable manufacture.

In the production of telecommunications cable, a cable core is manufactured from a plurality of individually insulated conductor wires (hereinafter referred to as "conductors") and a surrounding polymeric jacket is extruded around the core. To protect the insulation of conductors from the heat of the extrudate as it first contacts the core, a heat protective means is placed around the core before the jacket forming process. This heat protective means is commonly referred to as a core wrap which normally is in the form of an indefinite length of material with the desired thermal and physical characteristics, and which is a ribbon of sufficient width to wrap around the core with its side edge regions overlapped. To ensure that the core wrap remains in its desired position and does not expose the core wrap before jacket formation, a binding tape is wrapped helically around the core wrap and the core immediately after the core wrap is located around the core. A problem which exists, however, is that the speed of the process is seriously slowed down, leading to economical and practical disadvantages in production output caused by the rate of application of the binding tape. For instance, a jacketing speed which could otherwise be as high as 500 ft/min may be limited to around 180 ft/min which is the maximum binding speed.

The present invention is concerned with a method and apparatus for making an electrical cable in use of which the manufacturing speed may be increased beyond that normally allowed by the binding procedure.

The present invention provides method and apparatus in which the binding tape and the use of the binding procedure is avoided as the invention provides the use of a core wrap closure retaining guide between the core wrap and jacket forming stations.

Accordingly, the present invention provides apparatus for making an electrical cable comprising means to apply a core wrap to a core of insulated electrical conductors with side edges of the core wrap overlapped, an extrusion means downstream along a core pass line from the core wrap applying means for providing an extruded elastomeric jacket upon the core and core wrap, and intermediate the core wrap applying and extrusion means, the apparatus further comprises a core wrap closure retaining member having a surface facing towards the pass line for contacting the core wrap to hold the side edges in overlapped relationship as the core moves from the core wrap applying means and into the extrusion means.

In a preferred arrangement, the retaining member is provided with a core wrap engaging surface portion which, in side elevation, is convex and extends from a substantially rectilinear core wrap engaging portion. The retaining member is orientable between positions in which the rectilinear portion, on the one hand, and the convex portion on the other hand, face towards the pass line for contacting the core wrap. This arrangement is particularly useful in a case where the rectilinear portion is substantially long compared to any part of the convex portion which, at any time, may face directly across the pass line to contact the core wrap. Advantages are provided by these preferred features when the core applying means and the extrusion means are relatively movable towards and away from one another.

The distance between these two means may conveniently be greater upon start-up of the apparatus in which case the rectilinear core wrap engaging surface portion extends along the pass line to engage the core wrap over substantially the whole pass line between core wrap applying and extrusion means. As the distance is decreased, the retaining member is tilted so that the convex surface portion faces across the pass line and contacts the core wrap progressively along the convex surface portion during the tilting operation. Thus the length of contact between the retaining member and the core wrap lessens as the said distance decreases.

According to a further aspect of the invention, in a method of making an electrical cable, there are provided the steps of applying a core wrap to a core of insulated conductors by wrapping the core wrap around the core with side edges of the core wrap overlapping and contacting the core wrap with a retaining surface of a retaining member to hold the side edges in overlapped relationship until a jacket layer is extruded onto the core and the core wrap.

One embodiment of the invention will now be described, by way of example, with reference to the accompanying drawings, in which.

Figure 1:
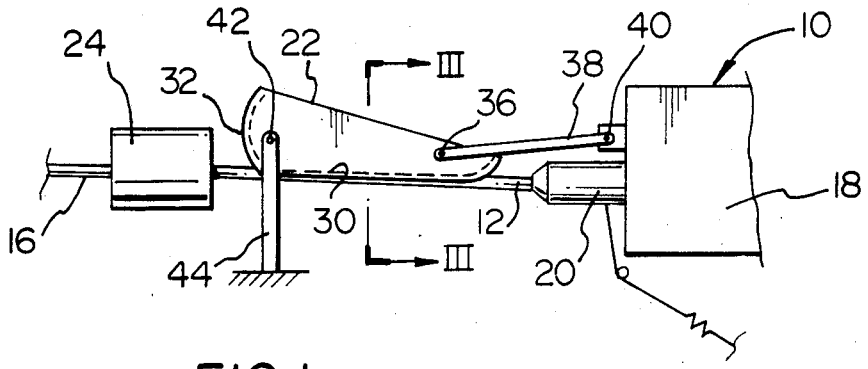
FIG. 1 is a side elevational view of an apparatus for applying a core wrap and an extruded jacket to a telecommunications cable core.
Figure 2:
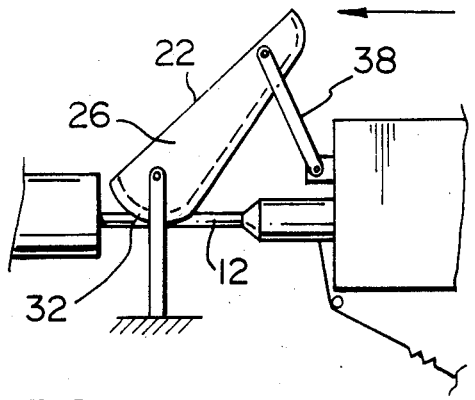
FIG. 2 is a view similar to FIG. 1 showing parts of the apparatus in different relative positions.

As shown by FIGS. 1 and 2 there is provided an apparatus 10 for wrapping a cable core wrap 12 (see FIG. 3) around a core 14 of a plurality of individually insulated conductors in the manufacture of a telecommunications cable for use within buildings. Such a cable is normally located within plenum ducts of a building.

The particular cable which is being made has a fire retardant powder substantially filling the interstices between the insulated conductors of the cable and the cable construction is similar to that described in a copending U.S. patent application Ser. No. 451,944, filed Dec. 21, 1982 and entitled "Inside Telecommunications Cable" in the names of J. A. Checkland and L. V. Woytiuk and now U.S. Pat. No. 4,562,302. The cable as described in that application is a fire retardant inside cable in which the insulation on each conductor is formed from a compound based upon polyvinylchloride. The core is surrounded by a fire resistant jacket which may be polyvinylchloride or preferably formed from a fluorinated polymeric composition and the powder lying between the conductors consists of alumina trihydrate particles. The fire retardant cable is devoid of a metal shield or sheath surrounding either the core or the jacket. In addition to this, in the present application, there is no binding tape surrounding the core wrap as is conventionally provided in cables.

The apparatus 10 for providing the core wrap and the extruder jacket 16 (see FIGS. 1 and 2) comprises, in sequence along the pass line for the cable core, a powder applicator 18, a core wrap applying means 20, a core wrap closure retaining member 22 and an extrusion means (not shown) which includes an extruder head 24 for applying the jacket 16 to the core. The powder applicator 18 is of conventional construction for filling the interstices in a cable core with powder. In this construction, the powder applicator comprises a fluidized bed of the powder and the cable core is passed through the bed, i.e. below its upper surface, so that the powder passes as a fluid into the interstices of the core. In addition, the core wrap applying means 20 and the extruder head 24 are of conventional construction and need no further description.

Figure 3:
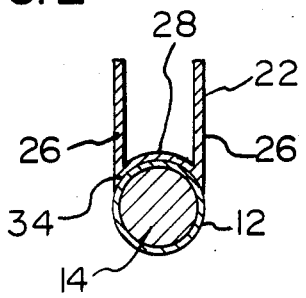
FIG. 3 is a sectional view taken along line III—III in FIG. 1 and on a larger scale, through part of the apparatus and through a cable core.

The apparatus according to the embodiment is devoid of a binding tape applying means which is normally used for holding a core wrap in a closed position around a core until the extruder has applied the jacket onto the core. According to the present invention and in the embodiment, the binding tape applying means is replaced by the closure retaining member 22. As shown by the drawings, the retaining member 22 is formed by two parallel side plates 26 and a retaining shoe 28 which lies between the plates. The shoe, in cross-section as shown in FIG. 3, is arcuately shaped, i.e. it is partly circular so as to contact a substantial area of the core wrap as it passes beneath the shoe. Thus the concave surface of the shoe faces towards the pass line for the cable core. The shoe 28 is shaped with a rectilinear core wrap engaging portion 30 at an upstream end of the shoe. At the downstream end, the portion 30 extends into a convex core wrap engaging portion 32.

The powder applicator and core wrap applying means are movable towards and away from the extruder head 24 as shown by a comparison between FIGS. 1 and 2. The core wrap closure retaining member, notably the shoe 2B, is shaped so as to contact the overlapping side edges of the core wrap and surrounding areas so as to hold these edges overlapped as the core moves into the extruder head and for any relative position of the powder applicator and core wrap applying means to the extruder head 24. So as to allow for this relative movement and also to ensure contact between the member 22 and the core wrap, the core wrap is pivotable about two positions so as to change orientation with regard to the pass line of the core. As shown, the member 22 is pivoted at an upstream position 36 to a link 38 which is also pivoted at its other end 40 to the powder applicator 18. At a downstream position 42 the member 22 is pivoted to a fixed support 44.

In use of the apparatus and upon start-up, the powder applicator and core wrap applying means are moved upstream away from the extruder head 24 as shown in FIG. 1. These relative positions are used at commencement of operations to enable the operator to ensure that the apparatus is working correctly and that the core wrap is being applied in the desired manner before the powder applicator and means 20 is moved to a downstream position which is the normal running position of the apparatus. This running position is shown in FIG. 2. Upon start-up of the apparatus, the member 22 is disposed in the position shown in FIG. 1 with the rectilinear core wrap engaging portion 30 lying substantially parallel with the pass line of the core so as to engage the core wrap at the overlapping side edges along a substantial length of the feedpath. As may be seen from FIG. 1, this only leaves a small region of the core wrap which is not engaged by the member 22, that is the region immediately exiting the core wrap applying means and the region immediately before the extruder head. However, with a correct design of the member 22 these particular regions are insufficiently small to enable the core wrap side edges to move out of overlapping relationship. Hence upon start-up of the machine as the core wrap moves away from the means 20 in a position surrounding the core, the overlapped side edges and adjacent regions of the core wrap are engaged by the underside surface of the shoe 28, as shown in FIG. 3, to retain the core wrap side edges in their desired overlapped positions by frictional contact with the shoe. The degree of frictional contact is preferably controlled by allowing for adjustment of the fixed support 44 to adjust the vertical height of the shoe.

Upon steady running conditions being achieved and the final line speed of the core being attained, then for greater control of the process the powder applicator and the means 20 are moved into the position shown in FIG. 2. This movement is accompanied by rotating the link 38 about its pivot point 40 in a clockwise direction so as to raise the upstream end of the member 22. Hence, during the movement of the powder applicator and the means 20 to its downstream position, the member 22 is being pivoted so that the rectilinear portion 30 is raised away from the core and core wrap and is replaced by the convex core wrap engaging portion 32 which rotates into a position with parts of the portion 32 facing the feedpath. It follows that because of the change of shape from the portion 30 to the portion 32 then there is less contact between the member 22 and the core wrap and the distance of contact between the shoe 2B and the core wrap is reduced along the pass line. This is clear from a comparison of FIGS. 1 and 2. However, although this distance is reduced, there is still a sufficiently small region of the core wrap at each side of the member 22 which is not contacted by the shoe to ensure that the core wrap does not unwrap itself from the core. This is clear from a comparison between FIGS. 1 and 2 and the distance between the contact position of the shoe and core wrap and the parts of the apparatus lying upstream and downstream from it.

With the use of the above apparatus as described, because the binding tape applicator is omitted, then the speed of the core wrap applying and jacketing process may be limited by the speed at which these particular parts of the process may be operated instead of being limited by the speed of application of the binding tape. In this present embodiment, the speed of application of the core wrap and the jacket material is in the region of 500 ft/min. This is an increase in the speed possible when using a binding tape applicator where it is found that the maximum binding tape application speed is around 180 ft/min. It follows that the elimination of the binding tape application procedure results in a significant increase in speed of the apparatus. In addition to this, because of the design of the member 22, the relative movement between the powder applicator and core wrap on the one hand and the extruder head during and after start-up of the apparatus enables the core wrap to be held in its correct wrapped position even though the distance between the outlet from the means 20 and the extruder head changes. As a result, the invention in its preferred form provides distinct advantages over conventional constructions.

We claim:

1. Apparatus for making an electrical cable comprising means to apply a core wrap to a core of insulated electrical conductors with side edges of the core wrap overlapped, an extrusion means downstream along a core pass line from the core wrap applying means for providing an extruded elastomeric jacket upon the core and core wrap, and intermediate the core wrap applying and extrusion means, the apparatus further comprises a core wrap closure retaining member for contacting the core wrap to hold the side edges in overlapped relationship as the core moves from the core wrap applying means and into the extrusion apparatus, said retaining member having a core wrap engaging portion which is rectilinear in side elevation, the rectilinear portion merging into a convex core wrap engaging portion at one end, and the retaining member is orientatable between a position in which the rectilinear portion extends along and faces the pass line for contacting the core wrap and positions in which the convex portion faces towards the pass line.

2. Apparatus according to claim 1, wherein the rectiliner and convex portions in a cross-section normal to the feedpath have concave surfaces to face towards the pass line for contacting the core wrap.

3. Apparatus according to claim 1, wherein the retaining member is pivotally mounted at one end at a fixed location to enable it to be pivoted between said positions.

* * * * *